United States Patent [19]

Scholaert

[11] Patent Number: 4,897,901

[45] Date of Patent: Feb. 6, 1990

[54] MACHINE FOR BRUSHING FABRICS, EQUIPPED WITH COUNTER-PILE WORKERS AND WITH TEAZLES

[76] Inventor: Michel Scholaert, Rue Verte, Allée Marie Antoinette No. 6, 59420 Mouvaux, France

[21] Appl. No.: 283,183

[22] Filed: Dec. 12, 1988

[30] Foreign Application Priority Data

Dec. 21, 1987 [FR] France ..... 87 18242
Dec. 21, 1987 [FR] France ..... 87 18241

[51] Int. Cl.[4] ..... D06C 11/00
[52] U.S. Cl. ..... 26/33
[58] Field of Search ..... 26/31, 29, 33, 34, 35

[56] References Cited

U.S. PATENT DOCUMENTS

| | | | |
|---|---|---|---|
| 1,002,738 | 9/1911 | Mundorf | 26/33 |
| 3,114,189 | 12/1963 | Müllers | 26/33 |
| 3,175,224 | 3/1965 | Bertrand | 26/31 |

FOREIGN PATENT DOCUMENTS

| | | | |
|---|---|---|---|
| 1269987 | 6/1968 | Fed. Rep. of Germany . | |
| 1460564 | 9/1969 | Fed. Rep. of Germany | 26/31 |
| 571494 | 5/1924 | France . | |
| 799074 | 6/1936 | France | 26/33 |
| 822608 | 1/1938 | France . | |
| 1196286 | 11/1959 | France . | |
| 1214496 | 4/1960 | France . | |
| 1334486 | 8/1960 | France . | |
| 1388703 | 1/1965 | France . | |
| 2578861 | 9/1986 | France . | |
| 820383 | 9/1959 | United Kingdom | 26/31 |
| 873991 | 8/1961 | United Kingdom . | |
| 876154 | 8/1961 | United Kingdom . | |
| 1038366 | 8/1966 | United Kingdom | 26/31 |

*Primary Examiner*—Werner H. Schroeder
*Attorney, Agent, or Firm*—Shenier & O'Connor

[57] ABSTRACT

The brushing machine according to the invention comprises controlled brushing rollers of the counter-pile type as well as rollers of the teazle type, of small dimensions with respect to the width of the fabric to be brushed, mounted to rotate freely about their axis and covered with a card clothing whose teeth are directed parallel to the axis of rotation. The teazles are mounted side by side to form a line. The lines of teazles are mounted alternately with counter-pile workers on conventional raising machines or with counter-pile mini-T rollers on raising machines in which each worker is an assembly of small so-called mini-T rollers. The teazles and possibly the mini-T rollers are equipped at their ends with a protection means covering the zones of beginning and of end of clothing, for example a cap fast with the axis of rotation of the roller.

17 Claims, 3 Drawing Sheets

MACHINE FOR BRUSHING FABRICS, EQUIPPED WITH COUNTER-PILE WORKERS AND WITH TEAZLES

FIELD OF THE INVENTION

The present invention relates to the brushing of woven fabrics, knitted fabrics and non-woven fabrics with the aid of machines such as raising machines, which comprise brushing or ruffling rollers.

BACKGROUND OF THE INVENTION

Raising machines are equipped with worker rollers of two alternate types on the periphery of a revolving drum: the so-called "pile" workers and so-called "counter-pile" workers. Each of these workers consists of a roller whose rotation is controlled by the machine and which is covered with a clothing whose teeth are directed in the direction of advance of the fabric (pile) or in the direction opposite the advance of the fabric (counter-pile). In conventional raising machines, there are as many pile workers as counter-pile workers.

The role of the pile workers is to render parallel on the surface the fibers raised by the counter-pile workers; to that end, their speed of rotation is slightly less than that of the counter-pile workers, which effects the desired combing but also a scraping tending to remove the fibers already raised and to entrain the fabric towards the rear of the machine, which causes numerous well-known accidents of tear and marking of the fabrics on leaving the workers.

The operation of the raising machines has already been improved by French Pat. No. 76 01083, by reducing the number of pile workers with respect to the counter-pile workers.

Furthermore, French Pat. No. 85 03741 provides a brushing machine of which each pile or counter-pile worker is constituted by an assembly of small rollers (mini T) covered with respective pile or counter-pile clothings.

However, in neither of these machines is the problem connected with the detrimental action of the pile rollers, in complement of their normal function of rendering the fibers parallel, perfectly solved.

SUMMARY OF THE INVENTION

A machine for brushing woven fabrics, knitted fabrics or non-woven fabrics has now been found, and this is the subject matter of the present invention, which eliminates the drawback set forth above. This machine comprises, in known manner, controlled brushing rollers of the counter-pile type. According to the invention, it also comprises, on the path of the fabric, so-called teazle rollers, of small dimensions with respect to the width of brushing, mounted to rotate freely and covered with a card clothing of which the teeth are directed parallel to their axis of rotation.

The teazles are not controlled, but free to rotate; in this way, their rotation being due solely to the contact of the teeth catching on the fabric, there is no effect of scraping of the fabric, as was the case with the pile rollers.

The term working angle designates the angle complementary to 90° made, in the same plane, by the direction of the point of the teazle with the direction of displacement of said teazle. The teazles have a working angle adjustable as a function of the fabrics to be brushed. The working angle is preferably included between 0 and +15°. The working angle is zero when the axis of rotation of the teazle is perpendicular to the direction of displacement of the teazle and therefore of the fabric. In this latter case, the teazle has no specific action in complement of that of the counter-pile rollers.

Brushing rollers of the teazle type and the machines equipped with teazles are certainly well known, particularly by Patents FR-A-1 196 286 and GB-A-876 154. However, these machines are exclusively equipped with teazles, and not, as is the case of the invention, with brushing rollers whose rotation is controlled, of the counter-pile type and with freely rotating brushing rollers of the teazle type. The invention allows such a combination which leads to a better quality brushing.

In order to avoid the fibers raised by the counter-pile rollers winding around the axis of the teazles, the diameter of the teazles is advantageously greater than the length of the fibers raised during brushing, for example of the order of 50 millimeters.

In a preferred configuration, teazles are assembled side by side over a whole width of brushing, constituting a line of teazles.

When the brushing machine is a conventional raising machine, in which each counter-pile roller is a worker per se, supported by a drum, the lines of teazles are distributed over the whole periphery of the drum, alternately with one or more counter-pile workers.

In fact, it suffices, in a conventional raising machine, to replace all or part of the pile rollers by lines of teazles.

When the brushing machine is a raising machine of the type in which each counter-pile roller is one of the so-called Mini-T elements, mounted on the periphery of the same worker, in accordance with the teaching of French Pat. No. 85 03741, the lines of teazles are distributed over the whole periphery of said worker, alternately with one or more lines of counter-pile mini-T elements.

The teazle is advantageously equipped, at each of its ends, with protection means covering the zones of beginning and of end of card clothings. Where the brushing machine is equipped with lines of counter-pile mini-T elements, the mini-T rollers are themselves equipped, at each of their ends, with protection means covering the zones of beginning and of end of card clothing.

The purpose of these protection means is to avoid tearing or marking of the article along the end zones of the rollers, particularly when the tension exerted provokes penetration of the article in the space between two adjacent rollers, forming a hollow.

In this way, the protection means, even if they do not completely avoid the formation of the hollow provoked by the space between the rollers, protect the fabric from the aggressive action of the teeth equipping the end zones, of beginning and of end, of the card clothing. Consequently, no more tearing nor marking of the fabric is observed during the treatment.

According to a preferred embodiment of the protection means, they are fast with the brushing roller itself and consist, in a first variant, of two caps mounted at each of the ends on the axis of the roller. Each cap covers that part of the teeth placed at the corresponding end of the roller, of beginning or of end of clothing. The caps are driven in rotation, at the same time as the rollers. The outer surface of the cap in contact with the fabric is smooth or preferably rough or with barbs.

In a second variant embodiment in which the protection means are fast with the brushing roller, said protection means consist of a preferably preformed foam ring or portion of ring, following the hollow shape formed on the surface of the roller by the beginning and the end of the clothing.

According to another embodiment, the protection means are not fast with the brushing roller, but consist, for a given roller, of two fixed caps mounted on the two supports of the roller. The supports in question allow fastening on the drum of the machine of bearings in which the shaft of the roller is mounted to rotate freely in the case of the teazles, and controlled in rotation in the case of the pile and counter-pile mini-T elements.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
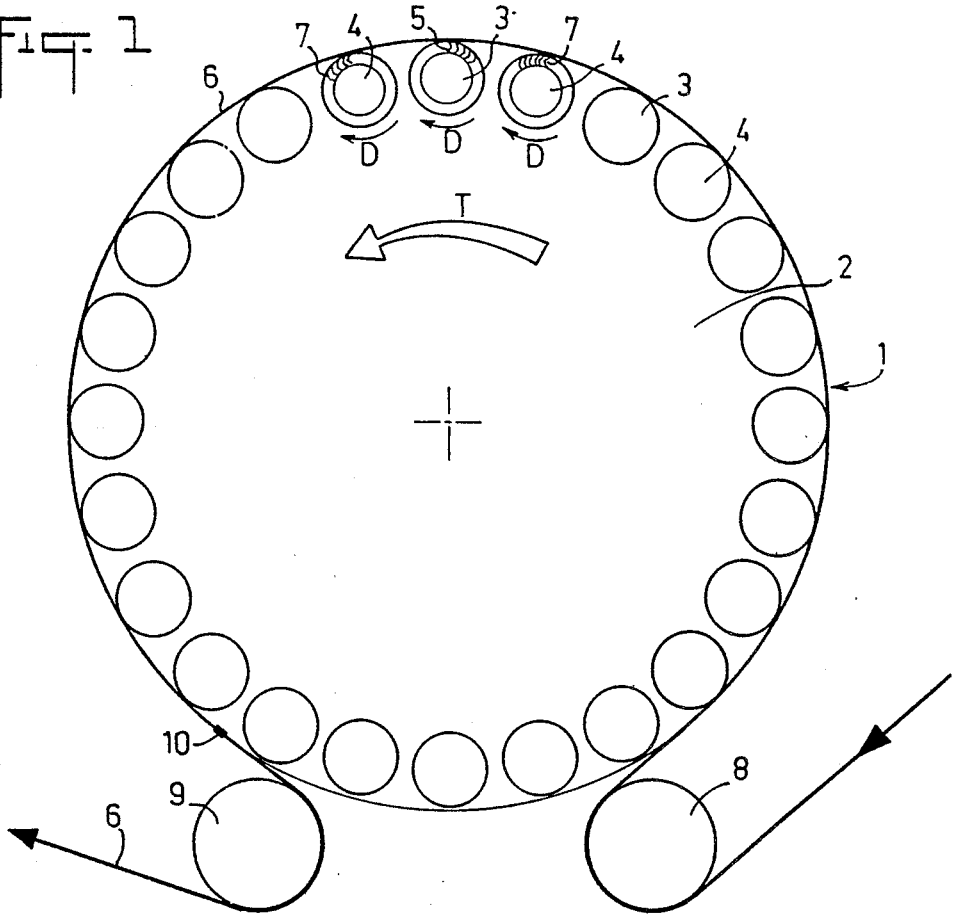
FIG. 1 is a schematic view in section of a conventional raising machine.

Referring now to the drawings, the conventional raising machine 1 is constituted by a drum 2, animated by a movement of rotation in the direction of arrow T. On the periphery of the drum 2 are mounted twenty four workers, twelve pile workers 3 and twelve counter-pile workers 4. As shown in FIG. 1, the pile workers 3 are covered with a clothing of which the teeth 5 are oriented in the direction of rotation of the drum 2, which is also the direction of displacement of the fabric 6; on the other hand, the counter-pile workers 4 are covered with a clothing whose teeth 7 are oriented in the direction opposite arrow T. Rollers 8 and 9 are placed in the lower part of the periphery of the drum 2, respectively where the fabric 6 enters and leaves.

The circumferential speed of the drum, at the level of the outer surface of the workers, is fixed, of the order of 350 meters per minute. The workers have an adjustable speed, they are controlled in rotation in the direction of arrow D, opposite that of the drum, for example, the counter-pile workers at a circumferential speed of 340 m/min and the pile workers at a circumferential speed of 360 m/min, the fabric 6 being driven by means (not shown) at a speed of 20 m/min. In the raising machine 1, the fabric 6 enters at roller 8, it passes around the workers 3 and 4 mounted on the periphery of the drum 2, and leaves at roller 9.

The counter-pile workers raise the fibers available on the surface of the fabric 6 which is opposite the raising machine, whilst the pile workers render parallel the fibers already raised. The action of the pile workers is accompanied by a scraping of the surface of the fabric, which may be the cause of pulling of fibers, tear of the fabric, and even of marking of the fabric at the exit 10 of the raising machine.

Figure 2:
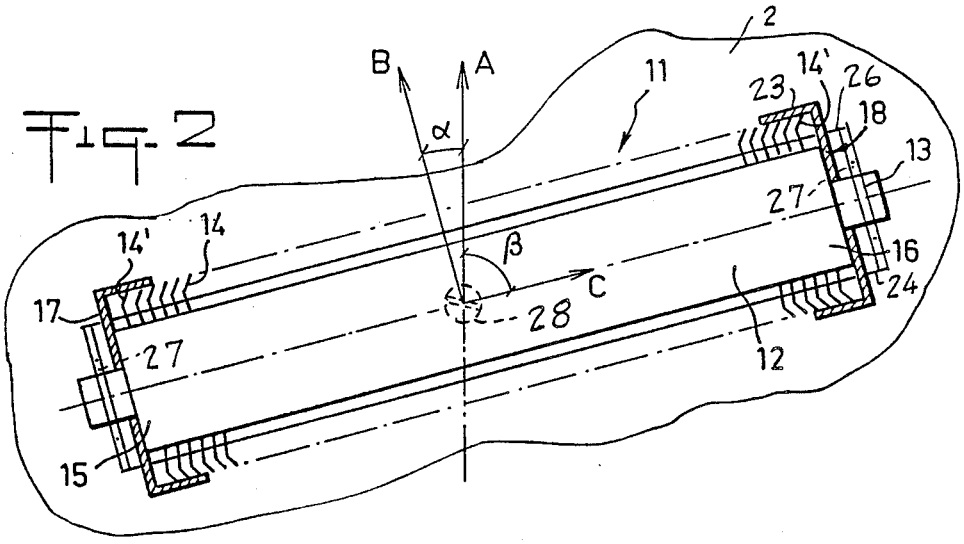
FIG. 2 is a view in section of a teazle.

According to the invention, in the conventional raising machine 1, the twelve pile workers are replaced by six lines composed of teazles 11 as illustrated in FIG. 2, and by six counter-pile workers.

The teazle 11 is constituted by a roller 12, mounted to rotate freely on a pin 13. The surface of the roller 12 is covered with a clothing whose teeth 14 are directed parallel to the axis of rotation 13. The two ends 15 and 16 of the roller 12 are provided with two caps 17 and 18 respectively, fixed on the pin 13 and covering over a short distance the teeth 14' located at ends 15 and 16.

The two ends of pin 13 are mounted in supports 26, fixed on the drum 2 and comprising bearings 27 in which the pin 13 is free to rotate. The positioning of the supports on the drum is adjustable by means of screw 28 or the like so as to allow possible variation of the working angle of the teazle. In FIG. 2, the working angle $\alpha$ is the angle complementary of angle $\beta$ which is included between the general direction of displacement of the teazle 11 during rotation of the drum 2 (arrow A) and the general direction of the teeth of the teazle (arrow C). The possibilities of adjustment of the working angle $\alpha$ are included between 0° and 20°. A zero working angle $\alpha$ corresponds to the case of the teazles of the same line being aligned transversely, and being parallel to the counter-pile workers 4.

During operation of the raising machine 1, the counter-pile workers 4 exert their usual action of seizing and pulling the fibers accessible on the surface of the fabric 6. Concerning the action of the teazles, it is observed that their presence brings about a reduction in the tension of the fabric 6 between the counter-pile workers. This reduction in tension improves the ease of penetration of the teeth 7 of the counter-pile workers 4 in the fabric, and therefore productivity.

The teazle 11 has an outer diameter of 51 mm and a length of 200 mm.

Figure 3:
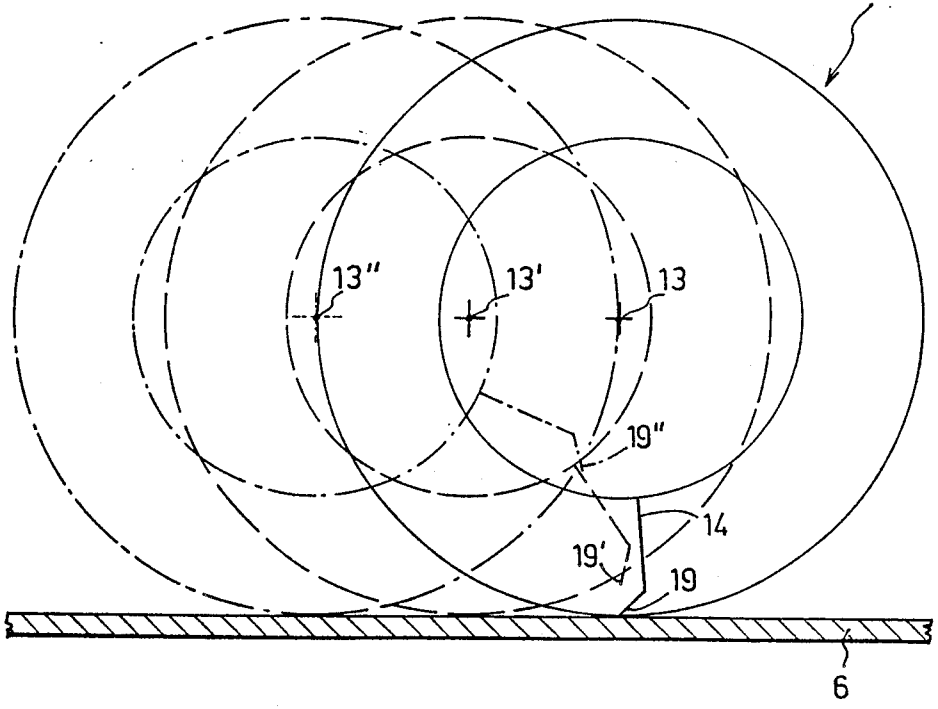
FIG. 3 is a schematic view showing the action of the teazle on the fabric.

FIG. 3 shows, in three distinct phases, the kinematics of the action of a tooth of a teazle on the fabric 6. At time t, the teazle 11 is in contact with the fabric 6 via tooth 14. The end 19 of the tooth 14 is in contact with a fiber of fabric 6 and, thanks to its non-zero working angle, can raise it; this end 19 lies vertically with respect to the axis of rotation 13 of the teazle 11.

At time (t+1), the teazle has moved so that its axis of rotation is located at 13' and has rotated on itself so that the end 19 of the tooth is located at 19', above the fabric 6. The fiber, which is taken by the end 19 of the tooth, is raised.

At time (t+2), the axis of rotation is at 13'' and the end of the tooth at 19''. The fiber is clearly raised from the fabric 6.

The action which has just been described is carried out without particular tension on the fabric, and what has been stated for one tooth is, of course, generalized for all the teeth in contact with the fabric 6.

The brushing obtained thanks to the combination, on the conventional raising machine, of counter-pile workers 4 and of lines of teazles 11, is improved: this gives a basic treatment, well covered and bulked, of very good quality.

The possibility of adjusting the working angle of the teazles makes it possible to vary the action of the teazles with respect to that of the counter-pile workers 4. The angle $\alpha$ is preferably included between 10° and 15°. In the extreme case of the working angle $\alpha$ being zero, the ends 19 of the teeth 14, during rotation of the teazle 11, no longer raise the fibers of the fabric, and only the counter-pile workers have an action on the fabric, which corresponds to a felting. In this way, the machine of the invention is a raising machine which may be converted, simply by adjusting the teazles 11, into a felting machine for molleton knitted fabrics or for felting already brushed articles.

In the above Example, the raising machine 1 comprised twenty four workers, namely eighteen counter-pile workers and six lines of teazles. By way of indication, Table I hereinbelow gives the recommended compositions for raising machines comprising different numbers of workers.

TABLE I

| Total number of workers | Number of counter-pile workers | Number of lines of teazles |
|---|---|---|
| 24 | 18 | 6 |
| 24 | 16 | 8 |
| 28 | 21 | 7 |
| 30 | 20 | 10 |
| 32 | 24 | 8 |
| 36 | 24 | 12 |
| 36 | 27 | 9 |

The above Example, employed in a conventional raising machine, does not limit the invention. In particular, the invention is applied in the same manner in a raising machine based on the teaching of French Pat. No. 85 03741 in which each worker is itself composed of an assembly of small rollers (mini-T) covered with card clothing: all the mini-T elements of a pile worker are covered with clothing in the direction of the pile; similarly, all the mini-T elements of a counter-pile worker are covered with clothing in the counter-pile direction. In that case, according to the invention, certain lines of Mini-T will be replaced by lines of teazles.

Caps 17 and 18 are adapted to cover at the two ends of the teazle 11 the zones corresponding to the beginning and to the end of the clothing. What is stated hereinafter concerning the means for producing the ends of the teazles is also valid for the mini-T rollers.

Figure 4:
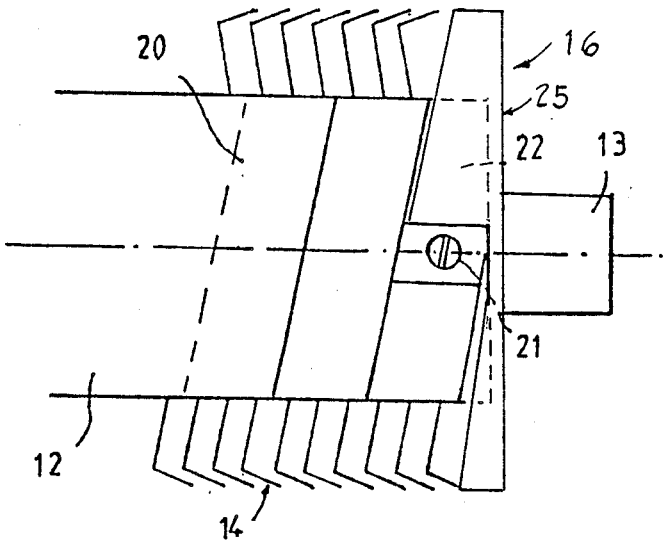
FIG. 4 is a schematic side view of the end of a teazle not equipped with the protecting cap.

FIG. 4 shows the end 16 of a teazle 11 not fitted with its cap 18. The card clothing has the form of a ribbon 20 and its assembly on the body of the roller 12 is effected by helically winding the ribbon 20 in contiguous manner. The ribbon 20 is glued on the body 12, and each of the two ends of the ribbon is, moreover, fixed on the body 12 with the aid, for example, of a screw 21. Taking into account the helical winding of the ribbon 20, part 22 of the surface of the body 12 is not coated by the clothing 20.

The damage made to the fabric during a brushing treatment when the fabric takes a hollowed form between the brushing rollers of small dimensions, can doubtlessly be explained by the heterogeneous positioning of the teeth 14 on the periphery of the rollers at their end parts.

Cap 18 is mounted at the end of body 12 on the element 13 forming the axis of rotation of the teazle. It has a part 23 in annular form.

This ring 23, centered on the axis of rotation of the roller, has a diameter slightly greater than that of the body 12 equipped with its teeth 14; moreover, the ring 23 extends over the whole periphery of the end 16 of the body 12 over a sufficient distance to ensure covering of that part 22 of the body 12 not covered with card clothing 20, and even of the first tooth 14'.

The ring 23 is fixed on the central element 13 via a connection element 24 which may be a flat, circular washer having the same diameter as the ring 23.

The ring 23 is advantageously made of metal. Its outer surface will be smooth or advantageously rough or with barbs, in order to avoid the phenomena of marking on the fabric.

Cap 18 may be replaced by a portion of foam ring 25, possibly pre-shaped, following the hollow, i.e. zone 22, left on the surface of the roller 12 by the beginning or the end of clothing.

The presence of the protection means is not limited to the helical fastening of the card clothing, it is also applicable when the clothing is one ribbon having the width of the roller to be clothed, which is fastened over the whole length of the generatrices. In that case in particular, the foam, possibly preshaped, will have the shape of a ring.

What is claimed is:

1. A machine for brushing fabrics, of the type comprising in particular brushing rollers of the counter-pile type, wherein it further comprises rollers of the teazle type, of small dimensions with respect to the width of the fabric, mounted to rotate freely, covered with a card clothing of which the teeth are directed parallel to their axis of rotation.

2. The machine of claim 1, wherein the rollers of the teazle type have a working angle adjustable as a function of the fabrics to be brushed.

3. The machine of claim 2, wherein the working angle is included between 0 and 15°.

4. The machine of claim 1, wherein the diameter of the rollers of the teazle type is greater than the length of the fibers raised by brushing, preferably of the order of 50 mm.

5. The machine of claim 1, wherein each teazle is equipped at each of its two ends with a protection means covering the zones of beginning and of end of clothing.

6. The machine of claim 1, wherein rollers of the teazle type are positioned transversely over the whole width of brushing and form a line of teazles.

7. The machine of claim 6 in which the brushing rollers of the counter-pile type constitute workers supported by a drum, wherein the lines of teazles are distributed over the whole periphery of the drum, alternately with at least one counter-pile workers.

8. The machine of claim 6, of the type in which the brushing rollers of the counter-pile type constitute so-called mini-T elements mounted on the periphery of the same worker, wherein the lines of teazles are distributed over the whole periphery of said worker, alternately with one or more lines of counter-pile mini-T elements.

9. The machine of claim 8, wherein each counter-pile mini-T roller is equipped at each of its two ends with a protection means covering the zones of beginning and of end of clothing.

10. The machine of claim 5 wherein, for a given roller, the protection means consist of two fixed caps mounted on the two supports of the roller.

11. The machine of claim 9, wherein, for a given roller, the protection means consist of two fixed caps mounted on the two supports of the roller.

12. The machine of one of claim 7 or 8, wherein, the teazles of each line are adjusted with a zero working angle, the machine then operating as a felting machine.

13. The machine of claim 5 wherein the means for protecting the teazle roller consists of a cap fixed on the shaft.

14. The machine of claim 9 wherein the means for protecting the counter-pile mini-T roller consists of a cap fixed on the shaft.

15. The machine of one of claims 13 or 14 wherein the cap has an outer surface, in contact with the article to be brushed, which is rough or provided with barbs.

16. The machine of claim 5, wherein the means for protecting the teazle roller consists of a ring or portion of ring made of foam following the hollow left on the surface of the teazle roller by the beginning or the end of the clothing.

17. The machine of claim 9 wherein the means for protecting the counter-pile mini-T roller consists of a ring or portion of ring made of foam, following the hollow left on the surface of the counter-pile mini-T roller by the beginning or the end of the clothing.

* * * * *